US006912731B2

(12) United States Patent
Cass

(10) Patent No.: US 6,912,731 B2
(45) Date of Patent: Jul. 5, 2005

(54) NON-SLIP GLOVE

(76) Inventor: Norman Alvin Cass, 54 Foster Rd., Southwick, MA (US) 01077

( * ) Notice: Subject to any disclaimer, the term of this patent is extended or adjusted under 35 U.S.C. 154(b) by 0 days.

(21) Appl. No.: 10/320,695

(22) Filed: Dec. 17, 2002

(65) Prior Publication Data

US 2004/0199978 A1 Oct. 14, 2004

Related U.S. Application Data

(63) Continuation-in-part of application No. 10/260,691, filed on Aug. 7, 2002, now abandoned.

(51) Int. Cl.[7] ..... A41D 19/00
(52) U.S. Cl. ..... 2/161.1; 2/161.6; 2/160
(58) Field of Search ..... 2/16, 20, 158, 2/159, 160, 161.1, 161.2, 161.3, 161.6, 161.8, 163, 164; 451/523

(56) References Cited

U.S. PATENT DOCUMENTS 3,748,792 A * 7/1973 Lamb ..... 451/523
3,789,555 A * 2/1974 Means ..... 451/523
3,867,947 A * 2/1975 Schack ..... 606/125
4,038,787 A * 8/1977 Bianchi ..... 451/523
5,134,809 A * 8/1992 Morton et al. ..... 451/523
5,642,527 A * 7/1997 Savage ..... 2/161.8
6,557,178 B1 * 5/2003 Hoover ..... 2/161.6
6,575,822 B2 * 6/2003 Lowe et al. ..... 451/526
6,604,244 B1 * 8/2003 Leach ..... 2/161.6

* cited by examiner

*Primary Examiner*—Gary L. Welch

(57) ABSTRACT

A non-slip glove for all types of weather is disclosed where emory cloth is employed as an exterior friction material to prevent and substantially eliminate slipping from the surface of a moving object as well as handles of golf clubs and baseball bats. The glove has applications to other environments such as construction workers using high-speed drills, drum hammers and the like. Further a finer grit emory cloth has been employed in the interior surface of the glove so as to not irritate the skin but maintain friction contact with the hand so that moisture that may enter inside the glove will not cause the glove to slip on the hand.

18 Claims, 4 Drawing Sheets

NON-SLIP GLOVE

RELATED APPLICATIONS

The present application is a continuation-in-part of application Ser. No. 10/260,691 entitled Sporting Glove, filed Aug. 7, 2002, now abandoned.

BACKGROUND OF THE INVENTION

1. Field of Invention

The present invention relates generally to the field of gloves. More specifically, the present invention is related to a glove used during athletic play that provides a gripping surface used to improve performance and accuracy while gripping or releasing an object.

2. Discussion of Prior Art

The use of gloves to protect as well as aid in performance is well known in sports, work, and other activities. Gloves have been particularly used in sports for improvement in gripping objects such as a bat, club, racquet, etc., as well as in other sports for catching an object such as a ball. In addition, some gloves have areas or patches provided with a roughened surface that aids in gripping an object. However, the location of these gripping areas does not necessarily allow for maximum improvement in an athlete's performance. Also, these gripping areas do not necessarily aid in the release of a ball or similar object.

Most gloves are used for gripping (for instance, while running, hitting, or catching) an object rather than for improving accuracy in an athlete's release, such as obtaining a greater angle or distance when the ball is released. Pads and patches of gripping material have been provided in certain areas, such as fingertips and the palm of the hand; however, the use of the glove material in addition to the gripping material does not allow sensory feeling of the object in hand.

Gloves of the prior art illustrate the use of gripping surfaces on gloves. For instance, U.S. Pat. No. 3,096,523 (Bruchas) provides a football glove with a snap-securing device having patches on the tip portions of the finger and thumb stalls composed of a tenacious gripping material unaffected by moisture. There is no mention of gripping material on the fingers other than the tips, and there are no holes in the glove. U.S. Pat. No. 3,404,409 (Tillotson et al.) comprises a glove having a series of discrete spots for knobs of tough abrasion-resistant substance or tread made of a polyvinyl chloride plastisol composition arranged in narrow rows or strips extending along the fingers and palm. No holes are provided in the glove. U.S. Pat. No. 3,504,379 (Glick) describes an athletic glove secured to the hand by a pair of triangular attachment straps with a suitable, releasable, selectively adhering grip retention means (such as Velcro®) on the gripping portion of the glove, such as the heel of the palm section, forefinger, and thumb stalls. The gripping portions, however, are not provided on the fingers, and there is no mention of holes in the fingers or palm of the glove.

U.S. Pat. No. 4,624,016 (Luevano) describes a laminated glove having a cushion on the underside/palm of the hand. Similarly, U.S. Pat. No. 5,983,397 (Seminara) discusses a batting glove including a hook and loop fastener and an elongated raised rubber pad disposed along the palm portion to encourage proper bat grip. Both of these patents have pads to provide both cushioning and gripping aids, but do not discuss holes or finger grips.

U.S. Pat. No. 4,691,387 (Lopez) shows an athletic glove having a sewn palm, finger, and thumb trusses made of hook fastener material (such as Velcro®) to provide a secure, non-slip gripping engagements with handles of athletic gear.

Holes are not provided in the glove. The gripping portions are provided on the palms and at the end of the fingers (near the palm) and do not extend through the entire finger length. Also, although the fingertips in one embodiment may be exposed, it neither provides a secure gripping mechanism nor a release aid to the user.

U.S. Pat. No. 4,038,787 (Bianchi) provides for a glove having a flexible body with a plurality of circular abrading units in each of the finger stalls, thumb, and palm. These units are not continuous on the finger, however, and no holes are provided.

U.S. Pat. No. 4,416,026 (Smith) discusses a mechanic's glove with a securing means and finger and thumb stalls. The index finger, thumb, and palm of the glove are provided with oval openings to aid in the control of the use of tools, and padding is provided on the backside of the glove to protect the hand. The glove is not, however, provided with water-resistant gripping material and further fails to include improved sport-implemented release/grip improvements.

Whatever the precise merits, features and advantages of the above-cited references, none of them achieves or fulfills the purposes of the present invention.

SUMMARY OF THE INVENTION

A glove having finger stall portions with an external and internal gripping surface and sensory relief holes therein that is worn and used during sporting events in order to perfect a user's skills and accuracy. The external and internal gripping surfaces enhance the confidence of the user, and also allow the user to maintain complete control of the ball (or other sporting equipment). By providing a gripping surface inside the finger stalls of the glove allows a user's hand to stay securely inside the stalls without the worry of their fingers slipping out and losing control of their grip. Also, by using a water resistant material such as 80 grit emory cloth, a user does not have to worry about weather conditions or sweaty palms when handling the ball.

In one embodiment, the glove comprises a three stall configuration with gripping surfaces and holes to assist a user in handling or shooting a basketball. The thumb and pinkie are left uncovered to allow full sensory contact with the ball.

DESCRIPTION OF THE PREFERRED EMBODIMENTS

Figure 1:
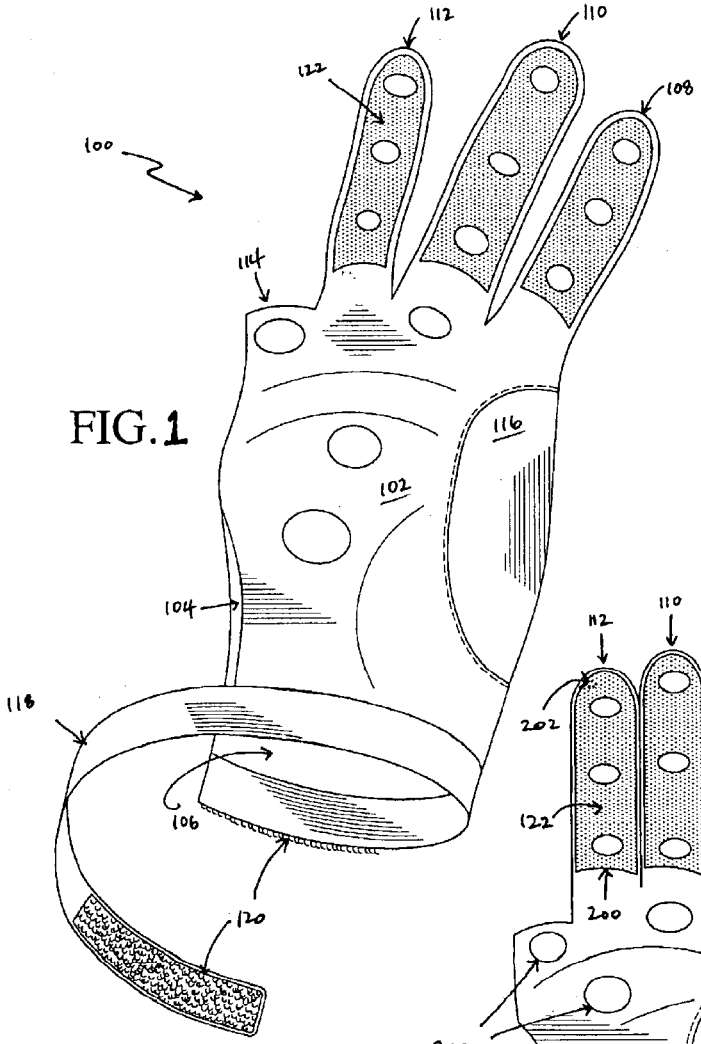
FIG. 1 illustrates a three-dimensional view of the glove used to aid in the gripping and handling of an object.

While this invention is illustrated and described in a preferred embodiment, the device may be produced in many different configurations, forms and materials. There is depicted in the drawings, and will herein be described in detail, a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the present invention.

In the sport of basketball, when players handle the ball, especially during shooting, it is required that they use their index, middle, and ring fingers (second, third, and fourth digits) to control the ball. FIG. 1 illustrates a present invention of the glove used to aid in gripping and handling an object, which, in this case, is preferably a basketball. The invention, however, should not be limited thereto. Other applications requiring a combination of gripping and touch are considered within the scope of the present invention. Glove 100 in its preferred embodiment has a chassis made of resilient type material and in FIG. 1 comprises palm portion 102, back portion 104, and wrist opening 106. As can be seen in both FIGS. 1 and 2, there are three finger stall portions 108, 110, and 112 used to cover the index, middle, and ring fingers (second, third, and fourth digits). Also shown are openings for the "pinky" finger (fifth digit) and thumb (first digit). The pinky finger is preferably uncovered and completely exposed through hole 114. Similarly, the thumb of the person wearing the glove preferably extends through hole 116, completely exposing the thumb and leaving the thumb uncovered.

When wearing the chassis of the glove 100, the user can secure glove 100 around their wrist by using wrist strap 118. Wrist strap preferably has a securing means thereon, such as a hook and loop fastening material 120. However, other securing means, such as snaps, slides, or ties, may also be used.

Figure 2:
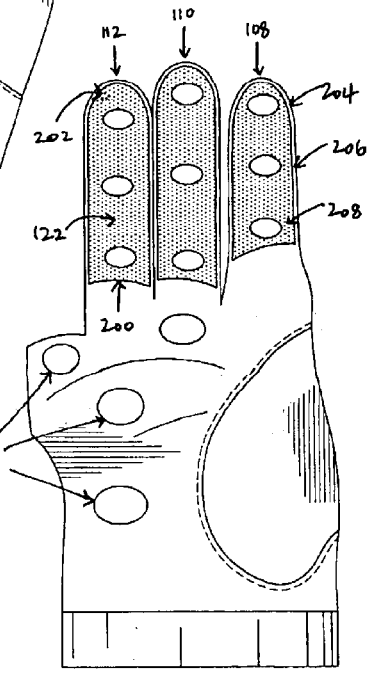
FIG. 2 illustrates a view of the palm and finger stall portions of the glove.

One important feature of the present invention is the use of a gripping surface on the external finger stalls of the glove. As can be seen in FIGS. 1 and 2, the finger stalls of the index, middle, and ring fingers have a gripping surface 122 thereon. FIG. 2 indicates the gripping surface preferably located on the "underside" of the fingers extending from the base 200 to the tip 202 of each corresponding finger. Full coverage of these fingers enables a more secure grip and enhances the confidence of the user.

To further aid in the confidence of the user, holes are provided in the finger stalls of the glove. The holes are preferably located on the sensory parts of the finger, i.e., holes 204, 206, and 208 are located on each extension, as indicated in FIG. 2. Also shown in FIG. 2 are holes 210 located in the palm portion of the glove. Again, these holes are preferably located in sensory portions of the palm. Holes 204, 206, 208, and 210 in these sensory areas allow the user to feel the grip of the basketball while handling, dribbling, and shooting the ball. Although the holes are shown having a circular or oval shape, it should be noted that the shape should not be limited. For example, triangular, oblong, square, rectangular, spherical, and other polygonal shapes may also be used to form the holes in the finger stall portions.

Figure 3:
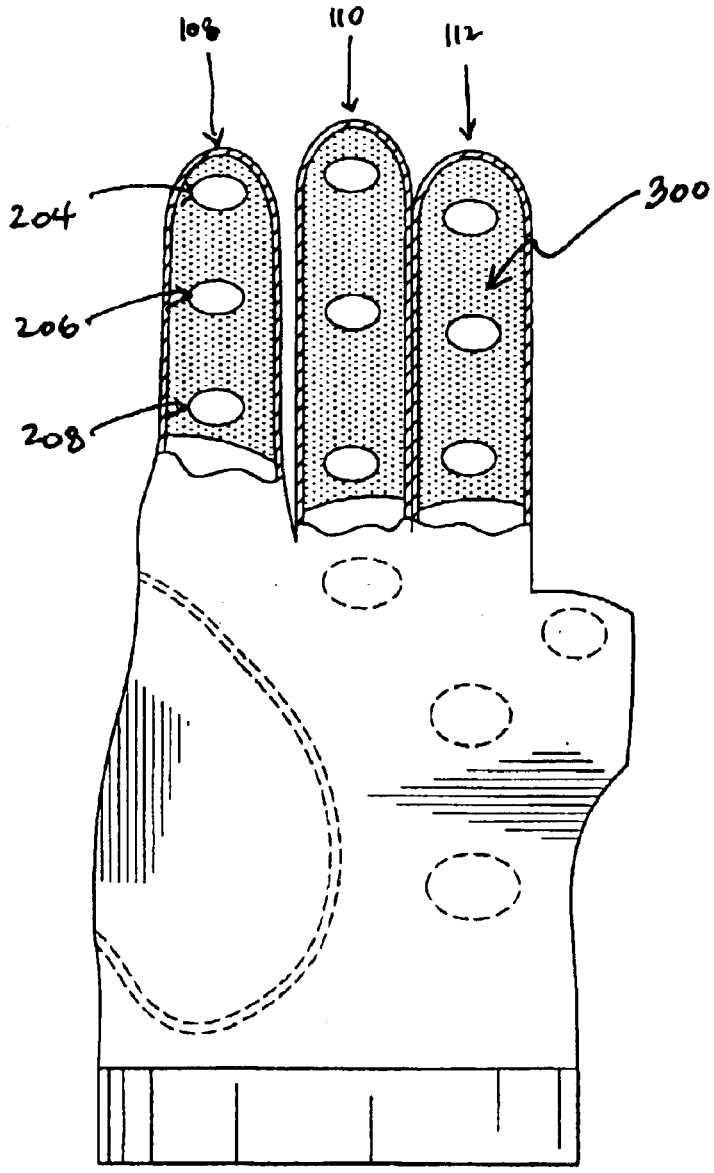
FIG. 3 illustrates the inside of the finger stalls of the preferred embodiment of the glove.

In the preferred embodiment, the present invention adds a gripping surface inside the finger stalls also brings benefit to the grip of the user. FIG. 3 illustrates a section of the inside of glove 100. Gripping surface 300 is located on each of the finger stalls 108, 110, and 112. Gripping surface 300 increases the resistance to slippage between skin and the internal glove surfaces.

Both the gripping surfaces and holes not only enhance the confidence of the user, but also allow the user to maintain complete control of the basketball during handling, dribbling, and shooting. Additionally, a user's accuracy with regard to distance or angling of the ball while shooting or passing is improved.

Figures 4, 5:
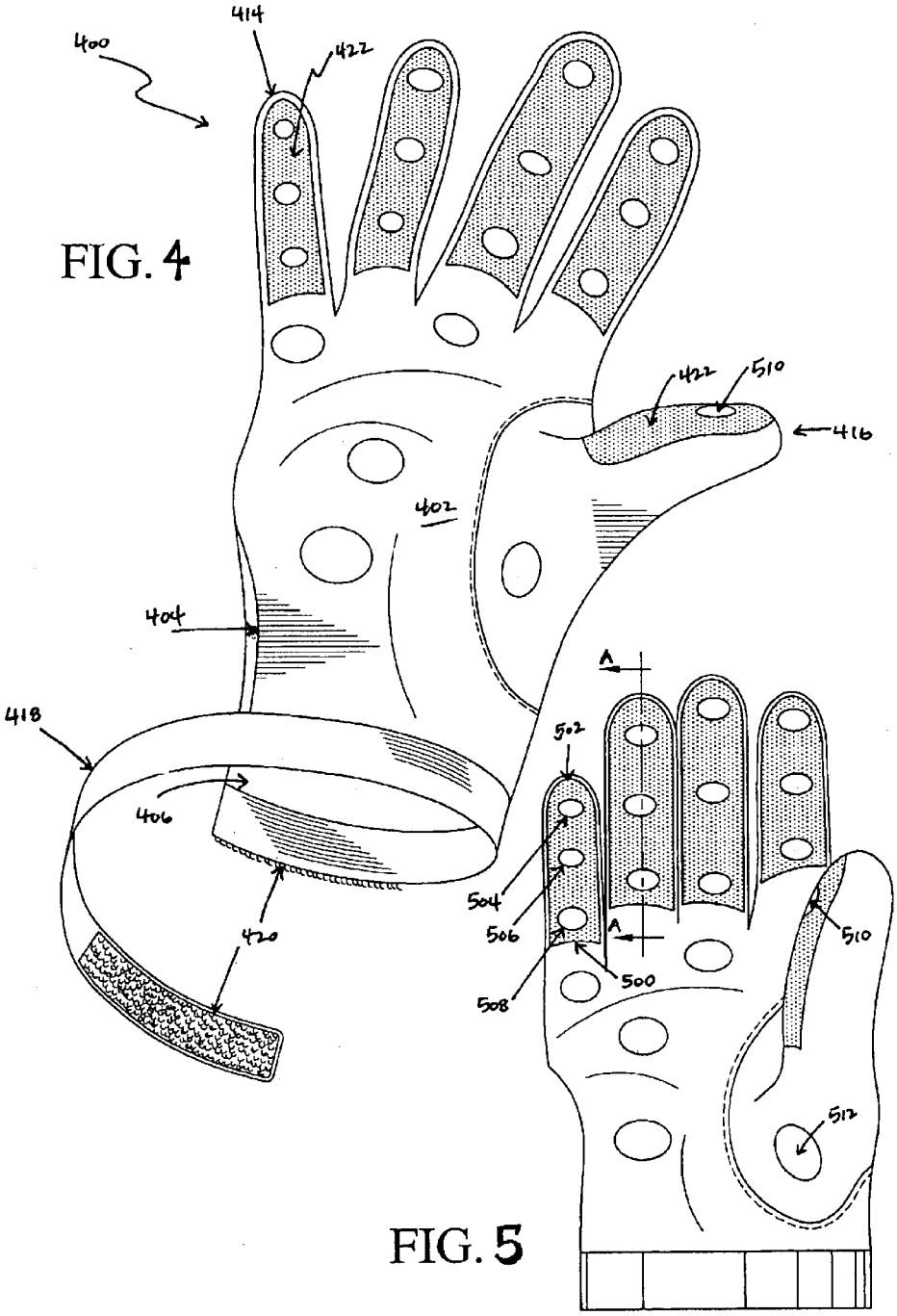
FIG. 4 illustrates a three-dimensional view of an additional embodiment of the glove.
FIG. 5 illustrates a view of the palm and finger stalls portions of the additional embodiment.

FIG. 4 illustrates an alternative embodiment of the present invention. Shown is glove 400 comprising palm portion 402, back portion 404, and wrist opening 406. As in the preferred embodiment, when wearing glove 400, one can secure glove 400 around his wrist by using wrist strap 418. Wrist strap 418 preferably has a securing means thereon, such as hook and loop fastening material 420. However, other securing means, such as snaps, slides, or ties may also be used.

Glove 400, as illustrated in FIGS. 4 and 5, has five finger stalls (four fingers and one thumb) to completely cover the hand of the user. A pinky finger stall portion 414 and thumb stall portion 416 have been added. Like the previously mentioned finger stalls, pinky and thumb portions 414 and 416 have a gripping surface 422 extending from the base 500 to the tip 502 of the finger stalls (indicated in FIG. 5). Also, as shown in FIG. 5, holes 504, 506, and 508 are located on the extensions and sensory parts of the pinky finger, and holes 510 and 512 are located on the sensory portions of the thumb. It should be noted that the use of this glove is not restricted to the sport of basketball, but rather by providing finger stalls over the pinky finger and thumb, the glove can be used in football, golf, and other sports that require a secure grip when handing and releasing sporting equipment.

Figure 6:
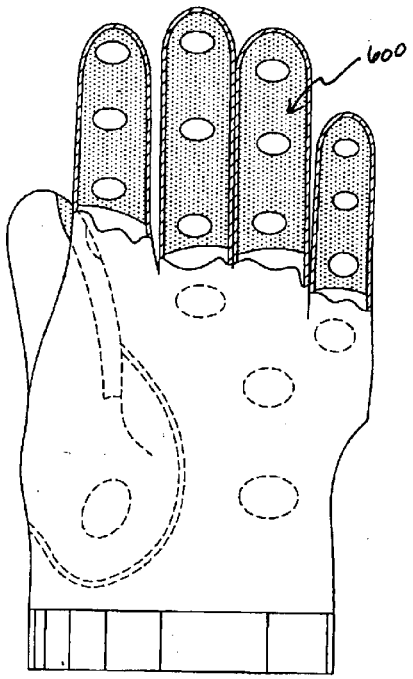
FIG. 6 illustrates the inside of the finger stalls of the additional embodiment of the glove.

FIG. 6 illustrates the inside of glove 400. As in the preferred embodiment, the use of a gripping surface inside the finger stalls also brings benefit to the grip of the user. Gripping surface 600 is located on each of the finger stalls of glove 400. Gripping surface 600 increases the resistance to slippage between skin and the internal glove surfaces.

Figure 7:
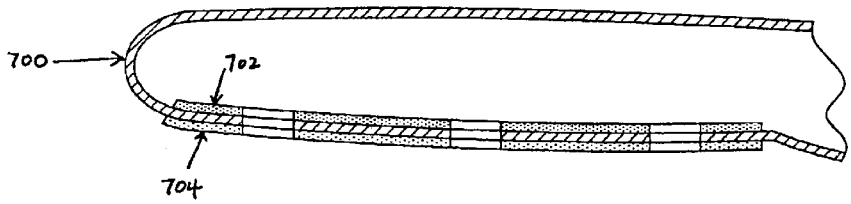
FIG. 7 illustrates a cross section of a finger stall of the glove.
Figure 8:
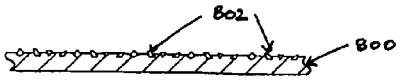
FIG. 8 illustrates the gripping surface.

An illustration of the orientation of the inside and outside gripping surfaces on a finger stall is provided in FIG. 7. Finger stall 700 is shown with inside gripping surface 702 and outside gripping surface 704, having holes therein as previously described to aid in gripping an object. Although FIG. 7 illustrates section A—A of FIG. 5, the section also applies to the finger stalls as shown in all figures. Again, both the gripping surface and holes not only enhance the confidence of the user, but also allow the user to maintain the confidence of having complete control of the object being handled, such as a football or golf club, as well as when the object is thrown or released. Additionally, the use of a weatherproof and fluid-resistant material for the gripping surface allows use of the glove during weather conditions such as heat, rain, snow, etc., without losing the gripping ability of the glove on the object. Also, due to the amount of constant physical activity in sporting events, many players' hands and/or palms become sweaty easily. A glove that has a gripping surface made of a material that is all-weather permitting and resistant to water or bodily fluids will further enhance the user's confidence and ability to control the position of an object. By providing a material that is resistant to water or bodily fluids, the user does not have to worry about the loss of his grip while wearing the glove. FIG. 8 illustrates a close-up of layer 800 having roughened surface 802 that is used on the finger stalls of the glove to enhance the grip of the user. Although the gripping surface is preferably described as a material, layer 800 may also comprise a coating. Layer 800 includes roughened surface 802 to enhance gripping ability and comprises any type of gripping particle. A preferred material used for the gripping surface on the finger stall portions is 80 grit emory cloth, or similar functional equivalents such as rock surface, sandpaper, rubberized coating, granular rubberized coating, and sand paint.

After many experiments in all types of inclement weather, 80 grit emory cloth being located on the exterior surface of the glove as shown in the figures of the drawings has been most successful in preventing slipping. Furthermore, it causes no damage to the surface of the balls and the like.

In order to prevent the glove from further slipping on the fingers of the hand as well as the palm of the hand, emory cloth of a grit of 110 has been most successful. It is sufficiently abrasive to cause friction connection to the skin of the hand without irritating the skin. The no-slip feature as shown in the drawings works in two ways. It makes friction contact with the surface of the ball, bat or handle on the outer surface of the glove, and it creates a friction fit with the surface of the fingers and palm of the hand. Other materials such as rubber, cloth, and plastics do not overcome the slip problem in inclement weather.

A special cement that is new and novel which is in the public domain, which has water proof qualities, hermetically seals the emory cloth to the main body or chassis of the glove.

The 80 grit emory cloth is so powerful it will remove rust from material. Consequently, it produces a new and unusual result in its application on the surface of the subject non-slip glove 100.

CONCLUSION

A system and method has been shown in the above embodiments for the effective implementation of a sporting glove. While various preferred embodiments have been shown and described, it will be understood that there is no intent to limit the invention by such disclosure, but rather, it is intended to cover all modifications and alternate constructions falling within the spirit and scope of the invention, as defined in the appended claims.

What is claimed is:

1. A non-slip glove supporting a person's gripping ability while handling an object, comprising:

a chassis having a flexible back portion and a flexible palm portion;

a wrist opening;

three or more finger stalls wherein said finger stalls having a gripping surface on an external and internal portion of each finger being covered;

said gripping surface substantially extends from the base of the finger being covered to the tip of the finger both internally and externally on the chassis.

2. A non-slip glove supporting a person's gripping ability while handling an object as in claim 1, wherein said finger stalls further comprise a plurality of relief holes exposing areas of the skin of said covered finger to aid in sensory perception and feeling said object.

3. A non-slip glove supporting a person's gripping ability while handling an object as in claim 1, wherein said palm portion further comprises a plurality of relief holes exposing areas of the skin of said palm to aid in the sensory perception and feeling said object.

4. A non-slip glove supporting a person's gripping ability while handling an object as in claim 2 or claim 3, wherein said relief holes are spherical or polygonal in shape.

5. A non-slip glove supporting a person's gripping ability while handling an object as in claim 1, wherein said gripping surface is resistant to moisture and slippery substances.

6. A non-slip glove supporting a person's gripping ability while handling an object as in claim 1, wherein said gripping surface is made of 80 grit material such as emory cloth, rock surface, sandpaper, rubberized coating, granular rubberized coating or sand paint.

7. A non-slip glove supporting a person's gripping ability while handling an object as in claim 1, wherein the covered fingers of the chassis of said glove consist of the index, middle and ring fingers.

8. A non-slip glove supporting a person's gripping ability while handling an object as in claim 1, wherein the pinky finger of said glove is uncovered, completely exposed and the finger extends through an opening in the chassis.

9. A non-slip glove supporting a person's gripping ability while handling an object as in claim 1, wherein the thumb of said glove is uncovered, completely exposed and the thumb extends through an opening in the chassis.

10. A non-slip glove supporting a person's gripping ability while handling an object as in claim 1, wherein the pinky finger and thumb of said person are uncovered, completely exposed and the said pinky finger and thumb extend through an opening in the chassis.

11. A non-slip glove supporting a person's gripping ability while handling an object, comprising:

a chassis having a flexible back portion and a flexible palm portion;

a wrist opening;

three or more finger stalls integral with said chassis;

said finger stalls having a gripping surface both on the external and internal portion of each finger being covered, wherein said gripping surface extends substantially from the base of the finger being covered to the tip of said finger, and;

wherein said finger stalls and said palm area of the chassis has a plurality of relief geometrical shaped holes exposing areas of the skin of said covered finger stalls and said palm area to aid in sensory perception and handling of said object.

12. A non-slip glove supporting a person's gripping ability while handling an object as in claim 11, wherein said interior and exterior gripping surface is resistant to moisture and slippery substances.

13. A non-slip glove supporting a person's gripping ability while handling an object as in claim 11, wherein said exterior gripping surface is made of an 80 grit material such as emory cloth, rock surface, sandpaper, rubberized coating, granular rubberized coating or sand paint and the interior surface of the chassis is made of 110 grit material so as not to abrade the skin of the person wearing the glove.

14. A non-slip glove supporting a person's gripping ability while handling an object as in claim 11, wherein the covered fingers of said glove include the index, middle and ring fingers.

15. A non-slip glove supporting a person's gripping ability while handling an object as in claim 11, wherein the pinky finger and thumb of said glove are uncovered and completely exposed.

16. A non-slip glove supporting a person's gripping ability while handling a basketball or the like comprising:

a chassis having a flexible back portion and a flexible palm portion;

a wrist opening:

a thumb opening;

a pinky opening;

three center finger stalls, wherein said center finger stalls have a separate gripping surface on the external and internal portion of each finger being covered;

said external and internal gripping surface extends substantially from the base of the finger being covered to the tip of said finger.

17. A non-slip glove supporting a person's gripping ability while handling a spherical shaped ball or a football as in claim 16, wherein said center finger stalls further comprise a plurality of relief holes exposing areas of the skin of said covered finger and said palm to aid in sensory perception and handling of said ball.

18. A non-slip glove supporting a person's gripping ability while handling balls as in claim 16, or 17, wherein said external gripping surface is made of 80 grit material such as emory cloth, rock surface, sandpaper, rubberized coating, granular rubberized coating or sand paint, and the internal surface of the chassis is made of 110 grit of said material so as not to abrade the skin of the person wearing the glove.

* * * * *